US009173252B2

(12) United States Patent
Lee et al.

(10) Patent No.: US 9,173,252 B2
(45) Date of Patent: Oct. 27, 2015

(54) INDUCTION HEATING COOKER AND METHOD OF CONTROLLING THE SAME

(75) Inventors: Sung Ho Lee, Suwon-si (KR); Jong Chull Shon, Suwon-si (KR); Ha Na Kim, Nam-gu (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 329 days.

(21) Appl. No.: 13/137,104

(22) Filed: Jul. 20, 2011

(65) Prior Publication Data

US 2012/0043312 A1 Feb. 23, 2012

(30) Foreign Application Priority Data

Aug. 5, 2010 (KR) ..... 10-2010-0075730

(51) Int. Cl.
*H05B 6/12* (2006.01)
*H05B 6/06* (2006.01)

(52) U.S. Cl.
CPC ..... *H05B 6/062* (2013.01); *H05B 2213/03* (2013.01); *H05B 2213/05* (2013.01)

(58) Field of Classification Search
CPC ... H05B 6/12–6/129; H05B 6/04; H05B 6/06; H05B 6/08
USPC ..... 219/620–627, 649–650, 655–656, 219/660–665, 668, 671
See application file for complete search history.

(56) References Cited

U.S. PATENT DOCUMENTS 5,808,280 A 9/1998 Gaspard
6,300,606 B1 * 10/2001 Engelmann et al. ..... 219/492
2003/0102303 A1 * 6/2003 Clothier et al. ..... 219/627
2007/0080158 A1 * 4/2007 Takimoto ..... 219/627
2007/0164017 A1 * 7/2007 Gouardo et al. ..... 219/626
2009/0120928 A1 * 5/2009 Lee et al. ..... 219/626

FOREIGN PATENT DOCUMENTS

| | | | |
|---|---|---|---|
| CN | 1332998 | A | 1/2002 |
| EP | 0716560 | A1 | 6/1996 |
| EP | 2 034 799 | A1 | 3/2009 |
| EP | 2034799 | A1 | 3/2009 |
| FR | 2863039 | | 6/2005 |
| WO | WO 94/05137 | | 3/1994 |
| WO | WO 97/37515 | | 10/1997 |

OTHER PUBLICATIONS

European Search Report for corresponding European Patent Application No. 11175478.4 dated Nov. 17, 2011 (in English).

(Continued)

*Primary Examiner* — Dana Ross
*Assistant Examiner* — Michael Laflame, Jr.
(74) *Attorney, Agent, or Firm* — Staas & Halsey LLP

(57) ABSTRACT

An induction heating cooker includes a plurality of heating coil blocks including one or more heating coils, a plurality of inverters to supply a high-frequency voltage to each of the heating coils, and a controller to control operations of the plurality of inverters to alternately supply the high-frequency voltage to each heating coil block and detect a heating coil, on which a container is placed, from among the heating coils belonging to each of the plurality of heating coil blocks. Using this configuration, it is possible to reduce the influence of magnetic field interference between adjacent heating coils when detecting the position of the container and to increase container position detection accuracy.

17 Claims, 10 Drawing Sheets

(56) References Cited

OTHER PUBLICATIONS

Korean Office Action mailed Jul. 29, 2014 in corresponding Chinese Application No. 10-2010-0075730.

Korean Notice of Patent Allowance issued Jan. 29, 2015 in corresponding Korean Application No. 9-5-2015-006600903.

Chinese Office Action issued Dec. 3, 2014 in corresponding Chinese Application No. 201110222283.0.

* cited by examiner

INDUCTION HEATING COOKER AND METHOD OF CONTROLLING THE SAME

CROSS-REFERENCE TO RELATED APPLICATIONS

This application claims the priority benefit of Korean Patent Application No. 2010-0075730, filed on Aug. 5, 2010 in the Korean Intellectual Property Office, the disclosure of which is incorporated herein by reference.

BACKGROUND

1. Field

Embodiments relate to an induction heating cooker able to heat a container regardless of the position of the container on a cooking plate.

2. Description of the Related Art

In general, an induction heating cooker supplies high-frequency current to a heating coil so as to generate a strong high-frequency magnetic field in the heating coil and generates eddy current in a cooking container (hereinafter, simply referred to as a container) magnetically coupled to the heating coil through the high-frequency magnetic field such that the container is heated by Joule's heat so as to cook food.

In such an induction heating cooker, a plurality of heating coils to provide a heating source is fixedly mounted inside a main body forming appearance. In addition, a cooking plate on which a container is placed is provided on an upper side of the main body. On this cooking plate, a container mark is formed at a position corresponding to the heating coil so as to enable a user to accurately place a container.

However, in order to cook food (heat the container) using such an induction heating cooker, the user needs to accurately place the container at a specific position of the cooking plate. That is, if a user does not place a container at an accurate position, food is not evenly heated.

Accordingly, a new induction heating cooker to cook food, regardless of the position of the container on a cooking plate, by arranging a large number of heating coils below the entire surface of the cooking plate has been developed.

If food is cooked using the newly developed induction heating cooker, it is necessary to perform an operation (container position detection operation) to detect a position where a container is placed on a cooking plate after a user places the container on the cooking plate and before a cooking operation starts.

In order to detect the position of the container on the cooking plate, a method of enabling high-frequency current to flow through the plurality of heating coils arranged below the cooking plate, measuring the value of current flowing through the heating coils, and detecting whether or not the container is placed on the heating coils using the measured current is used.

In the newly developed induction heating cooker, since the small-sized heating coils are densely arranged below the entire surface of the cooking plate, a distance between the heating coils is very small. In such an induction heating cooker, if high-frequency current is simultaneously supplied to all the heating coils in order to detect the position of the container, magnetic field interference occurs between adjacent heating coils and thus a container position detection error may occur. That is, when current flowing through any one heating coil (first heating coil) is measured to detect whether or not a container is placed on the heating coil (first heating coil), noise occurs by magnetic field interference with adjacent heating coils (second and third heating coils). Accordingly, it may be erroneously determined that the container is placed on a heating coil although the container is not actually placed on the heating coil. At this time, as a distance between heating coils is decreased, magnetic field interference with the adjacent heating coils is increased.

If a cooking operation is performed in a state in which a container position detection error has occurred, a heating coil on which the container is not actually placed is also driven. Thus, unnecessary power is consumed and an inverter (circuit element) included in the induction heating cooker may be damaged.

SUMMARY

Therefore, it is an aspect to provide an induction heating cooker to decrease magnetic field interference between adjacent heating coils when detecting the position of a container so as to increase container position detection accuracy and a method of controlling the same.

Additional aspects of the invention will be set forth in part in the description which follows and, in part, will be apparent from the description, or may be learned by practice of the invention.

In accordance with one aspect, there is provided an induction heating cooker including a plurality of heating coil blocks including one or more heating coils, a plurality of inverters to supply a high-frequency voltage to each of the heating coils, and a controller to control operations of the plurality of inverters to alternately supply the high-frequency voltage to each heating coil block and detect a heating coil, on which a container is placed, from among the heating coils belonging to each of the plurality of heating coil blocks.

The induction heating cooker may further include a cooking plate provided to place the container thereon, and the heating coils may be adjacently arranged below the cooling plate.

The induction heating cooker may further include one or more sensors to detect a value of current flowing in each heating coil, and the controller may detect the heating coil on which the container is placed according to the level of the value of current flowing in each heating coil detected by each sensor.

The controller may determine that the container is placed on the heating coil if the value of current flowing in a heating coil is greater than or equal to a predetermined value.

The predetermined value may be a value of current flowing in the heating coil when a container formed of a magnetic material occupies a predetermined ratio of the area of the heating coil.

The induction heating cooker may further include a display unit to display position information of the heating coil on which the container is placed.

The induction heating cooker may further include an operation unit to input a power level of the heating coil on which the container is placed.

The controller may control the operations of the plurality of inverters so as to supply the high-frequency voltage corresponding to the power level input through the operation unit to the heating coil on which the container is placed.

In accordance with another aspect, there is provided a method of controlling an induction heating cooker in which a plurality of heating coil blocks including one or more heating coils is arranged below a cooking plate so as to supply a high-frequency voltage to each of the heating coils, including alternately supplying the high-frequency voltage to each of the plurality of heating coil blocks, and detecting a heating coil, on which a container is placed, from among the heating coils belonging to each of the plurality of heating coil blocks.

The detecting of the heating coil on which the container is placed may include detecting a value of current flowing in each heating coil when the high-frequency voltage is supplied, and detecting the heating coil, on which the container is placed, according to the level of the value of current flowing in each heating coil.

If the value of current flowing in a heating coil is greater than or equal to a predetermined value, the heating coil may be determined to be the heating coil on which the container is placed.

The predetermined value may be a value of current flowing in the heating coil when the container formed of a magnetic material occupies a predetermined ratio of an area of the heating coil.

The method may further include displaying position information of the heating coil on which the container is placed.

The method may further include supplying the high-frequency voltage corresponding to a power level of the heating coil input by a user to the heating coil on which the container is placed.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
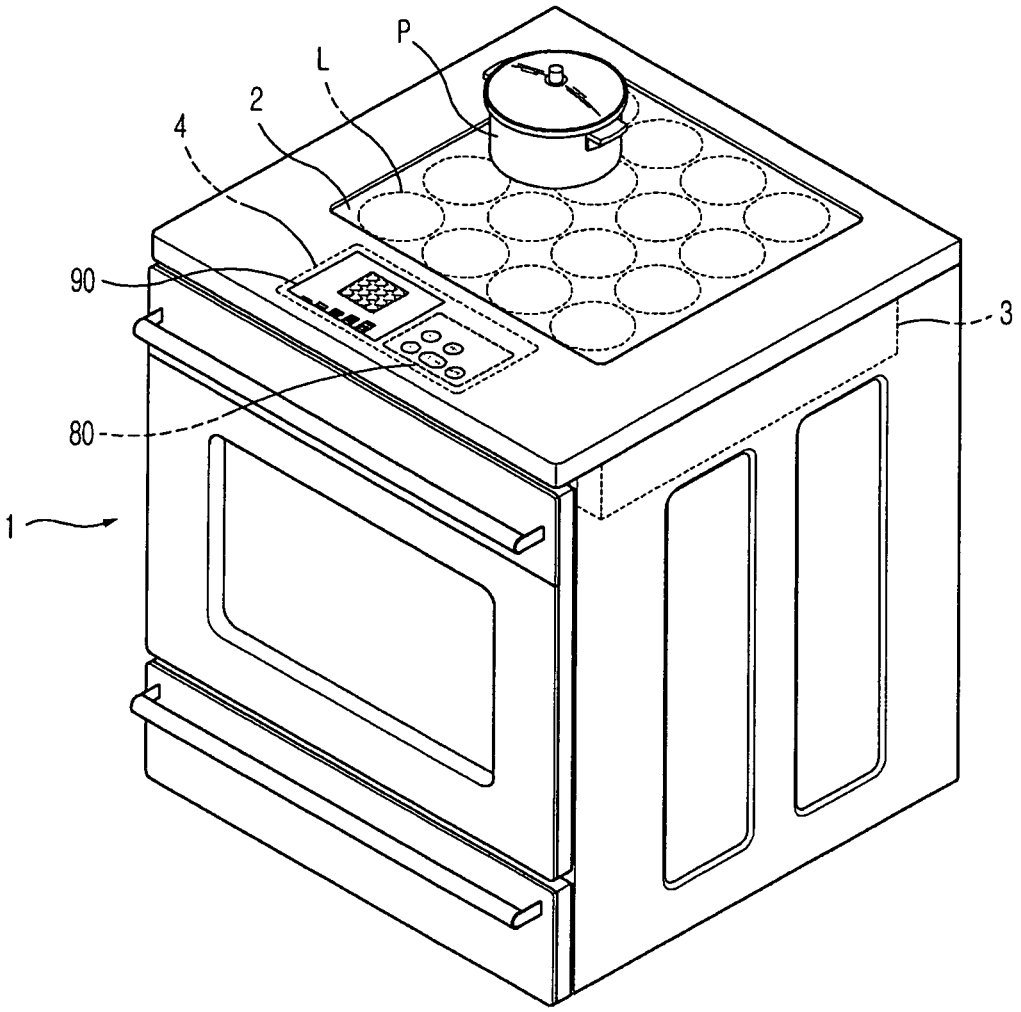
FIG. 1 is a perspective view showing the configuration of an induction heating cooker according to an embodiment.

Reference will now be made in detail to the embodiments, examples of which are illustrated in the accompanying drawings, wherein like reference numerals refer to like elements throughout.

FIG. 1 is a diagram showing the configuration of an induction heating cooker according to an embodiment.

As shown in FIG. 1, the induction heating cooker according to the embodiment includes a main body 1.

On an upper side of the main body 1, a cooking plate 2 on which a container P will be placed is provided.

In the main body 1, a plurality of heating coils L to provide a heating source to the cooking plate 2 is provided below the cooking plate 2. The heating coils L are adjacently arranged below the entire surface of the cooking plate 2. In the embodiment, 16 heating coils L are arranged in a 4×4 matrix.

A control device 3 to drive the heating coils L is provided below the cooking plate 2. The circuit configuration of the control device 3 will be described in greater detail with reference to FIGS. 2A to 2B.

A control panel 4 including an operation unit 80 including a plurality of operation buttons to input a command to the control device 3 in order to drive the heating coils L, and a display unit 90 to display information about an operation of the induction heating cooker, are provided on an upper portion of the main body 1.

Figure 2A:
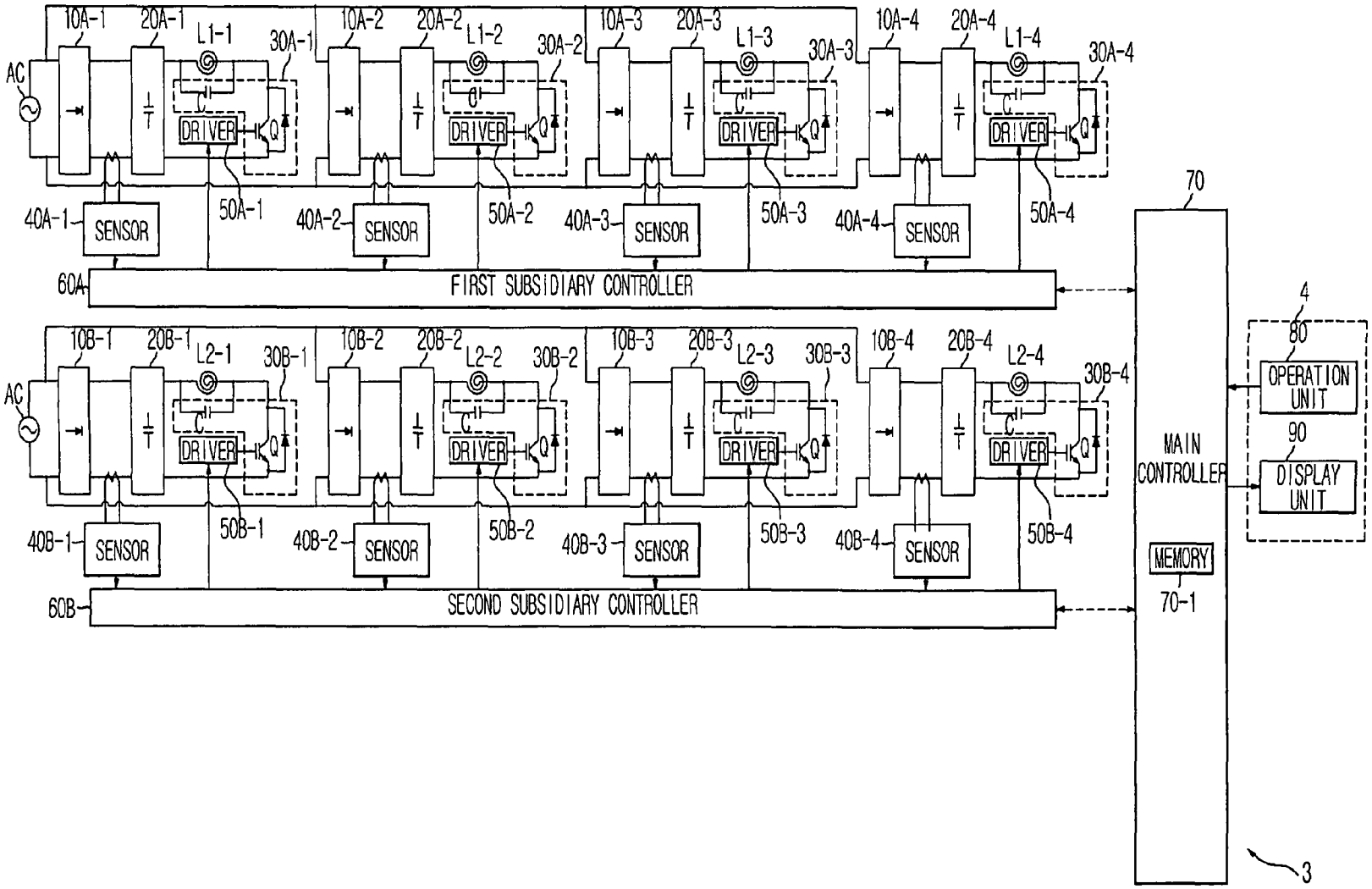
FIGS. 2A to 2B are block diagrams showing a control device of an induction heating cooker according to an embodiment.
Figure 2B:
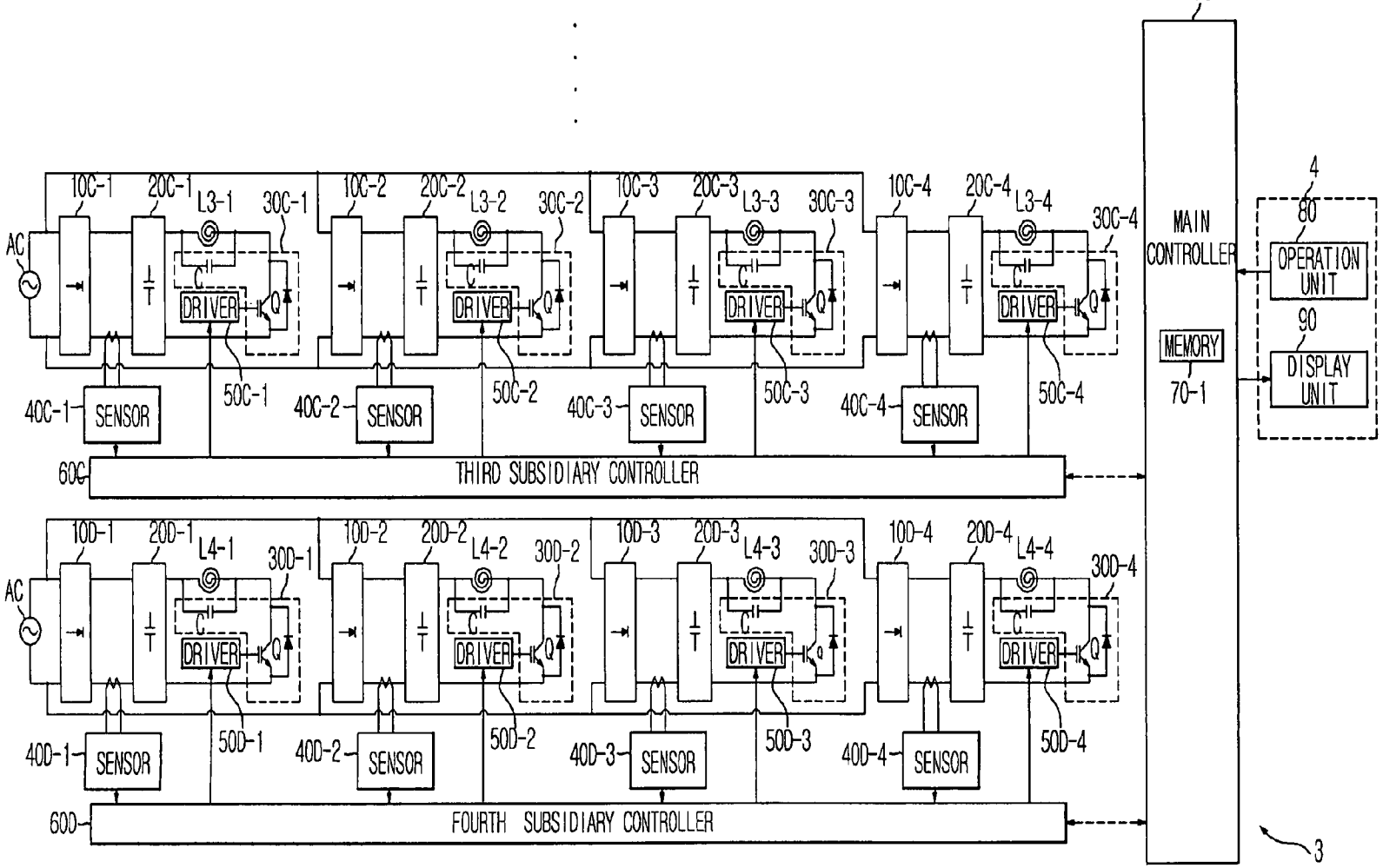

FIGS. 2A to 2B are block diagrams showing a control device of an induction heating cooker according to an embodiment.

As shown in FIGS. 2A to 2B, the control device 3 of the induction heating controller according to the embodiment includes four subsidiary controllers 60A, 60B, 60C and 60D, one main controller 70, an operation unit 80 and a display unit 90.

Each subsidiary controller 60A, 60B, 60C and 60D controls the driving of four heating coils which form one control unit among a total of 16 heating coils L arranged in the 4×4 matrix, and the main controller 70 is provided to control the four subsidiary controllers 60A, 60B, 60C and 60D.

In the embodiment, a configuration in which one subsidiary controller 60A, 60B, 60C or 60D is provided with respect to four heating coils of each row in the structure of the heating coils L arranged in the 4×4 matrix will be described. That is, the first subsidiary controller 60A controls driving of four heating coils L1-1, L1-2, L1-3 and L1-4 arranged in a first row of the 4×4 matrix, the second subsidiary controller 60B controls driving of four heating coils L2-1, L2-2, L2-3 and L2-4 arranged in a second row of the 4×4 matrix, the third subsidiary controller 60C controls driving of four heating coils L3-1, L3-2, L3-3 and L3-4 arranged in a third row of the 4×4 matrix, and the fourth subsidiary controller 60D controls driving of four heating coils L4-1, L4-2, L4-3 and L4-4 arranged in a fourth row of the 4×4 matrix. In a reference number LX-Y (X and Y are natural integers) denoting each heating coil L, "X" denotes a row number and "Y" denotes a column number. That is, a reference numeral "L1-1" denotes a heating coil L arranged at a first row and a first column of the 4×4 matrix.

Since the control configurations to drive the four heating coils L1-1 to L1-4, L2-1 to L2-4, L3-1 to L3-4 or L4-1 to L4-4 arranged in each row among the 16 heating coils arranged in the 4×4 matrix are identical, only the control configuration to drive the four heating coils L1-1, L1-2, L1-3 and L1-4 arranged in the first row of the 4×4 matrix will be described in detail and description of the control configurations to drive the heating coils L arranged in the other rows will be omitted.

As shown on FIGS. 2A to 2B, a part of the control device 3 to drive the four heating coils L1-1, L1-2, L1-3 and L1-4 arranged in the first row among the 16 heating coils arranged in the 4×4 matrix includes rectifiers 10A-1, 10A-2, 10A-3 and 10A-4, smoothing units 20A-1, 20A-2, 20A-3 and 20A-4, inverters 30A-1, 30A-2, 30A-3 and 30A-4, sensors 40A-1, 40A-2, 40A-3 and 40A-4, drivers 50A-1, 50A-2, 50A-3 and 50A-4, and the first subsidiary controller 60A.

The heating coils L1-1, L1-2, L1-3 and L1-4 are independently driven by the inverters 30A-1, 30A-2, 30A-3 and 30A-4 provided in correspondence with the heating coils 10A-1, 10A-2, 10A-3 and 10A-4. That is, the heating coil L1-1 is driven by the inverter 30A-1, the heating coil L1-2 is driven by the inverter 30A-2, the heating coil L1-3 is driven by the inverter 30A-3, and the heating coil L1-4 is driven by the inverter 30A-4.

The rectifiers 10A-1, 10A-2, 10A-3 and 10A-4 rectify input Alternating Current (AC) and output rectified pulsating voltages.

The smoothing units 20A-1, 20A-2, 20A-3 and 20A-4 smooth the pulsating voltages received from the rectifiers 10A-1, 10A-2, 10A-3 and 10A-4 and output the smoothed DC voltages.

The inverters 30A-1, 30A-2, 30A-3 and 30A-4 include switching elements Q to switch the DC voltages received from the smoothing units 20A-1, 20A-2, 20A-3 and 20A-4 according to switching control signals of the drivers 50A-1, 50A-2, 50A-3 and 50A-4 and provide resonance voltages to the heating coils L1-1, L1-2, L1-3 and L1-4 and resonance capacitors C to continuously resonate with the heating coils L1-1, L1-2, L1-3 and L1-4 by voltages input to the heating coils L1-1, L1-2, L1-3 and L1-4 in parallel.

If the switching elements Q of the inverters 30A-1, 30A-2, 30A-3 and 30A-4 are turned on, the heating coils L1-1, L1-2, L1-3 and L1-4 and the resonance capacitors C form parallel resonance circuits. In contrast, if the switching elements Q are turned off, charges stored in the resonance capacitors C when the switching elements Q are turned on are discharged and currents flow through the heating coils L1-1, L1-2, L1-3 and L1-4 in an opposite direction of the direction of the high-frequency current when the switching elements Q are turned on.

The sensors 40A-1, 40A-2, 40A-3 and 40A-4 are connected to a line between the rectifiers 10A-1, 10A-2, 10A-3 and 10A-4 and the 20A-1, 20A-2, 20A-3 and 20A-4. The sensors 40A-1, 40A-2, 40A-3 and 40A-4 detect the values of the currents flowing in L1-1, L1-2, L1-3 and L1-4 and provide the detected current values to the first subsidiary controller 60A, in order to detect the heating coils L1-1, L1-2, L1-3 and L1-4 on which the container P is placed. The sensors 40A-1, 40A-2, 40A-3 and 40A-4 are provided in correspondence with the heating coils L1-1, L1-2, L1-3 and L1-4 and include Current Transformer (CT) sensors (current sensors). In the embodiment, although the method of using the CT sensors as the sensors 40A-1, 40A-2, 40A-3 and 40A-4 and detecting the heating coils L1-1, L1-2, L1-3 and L1-4 on which the container P is placed using the values of the currents flowing in the heating coils L detected using the CT sensors is described, the heating coils L1-1, L1-2, L1-3 and L1-4 on which the container P is placed may be detected using various sensors such as a voltage sensor, a pressure sensor, an infrared sensor, etc.

The drivers 50A-1, 50A-2, 50A-3 and 50A-4 output driving signals to the switching elements Q of the inverters 30A-1, 30A-2, 30A-3 and 30A-4 according to control signals of the first subsidiary controller 60A so as to turn the switching elements Q on or off.

The first subsidiary controller 60A sends the control signal to each driver 50A-1, 50A-2, 50A-3 or 50A-4 according to a control signal of the main controller 70 and controls driving of each heating coil L1-1, L1-2, L1-3 or L1-4. The first subsidiary controller 60A receives the value of the current flowing in each heating coil L1-1, L1-2, L1-3 or L1-4 detected by each sensor 40A-1, 40A-2, 40A-3 or 40A-4 and transmits the current value to the main controller 70.

The main controller 70 controls the overall operation of the induction heating cooker. The main controller 70 is communicatively connected to the first to fourth subsidiary controllers 60A, 60B, 60C and 60D to control driving of the four heating coils L1-1 to L1-4, L2-1 to L2-4, L3-1 to L3-4 or L4-1 to L4-4 arranged in each row of the 4×4 matrix to send a control signal to the subsidiary controller 60A, 60B, 60C or 60D and control driving of the heating coils L1-1 to L1-4, L2-1 to L2-4, L3-1 to L3-4 or L4-1 to L4-4.

The main controller 70 detects a heating coil L, on which the container P is placed, from among the heating coils L using the values of current flowing through the heating coils L detected using the sensors 40A-1 to 40A-4, 40B-1 to 40B-4, 40C-1 to 40C-4 and 40D-1 to 40D-4, while controlling the operation of the inverters 30A-1 to 30A-4, 30B-1 to 30B-4, 30C-1 to 30C-4 or 30D-1 to 30D-4 so as to alternately perform a process of exclusively supplying a high-frequency voltage to only the heating coils L belonging to each heating coil block B according to a position detection command of the container P input through the operation unit 80 with respect to all heating coil blocks B.

The main controller 70 controls the operation of the inverters 30A-1 to 30A-4, 30B-1 to 30B-4, 30C-1 to 30C-4 or 30D-1 to 30D-4 so as to supply the high-frequency voltage corresponding to the power level of the heating coil L input through the operation unit 80 to the heating coil L, which is determined to be the heating coil on which the container P is placed, in order to perform a cooking operation.

The main controller 70 includes a memory 70-1 therein. The memory 70-1 stores an information about a plurality of heating coil blocks B into which the heating coils L of the induction heating cooker are divided and a reference value (predetermined value) to determine whether or not the container P is placed on the heating coil L.

The operation unit 80 includes a plurality of buttons, for example, such as an ON/OFF button to turn power on or off (see 82 of FIG. 6), an AUTO button (see 84 of FIG. 6) to input a command of a container position detection operation, a +/− button (see 86 of FIG. 6) to adjust the power level of the heating coil L, and a start/pause button (see 88 of FIG. 6) to input start or pause of a cooking operation.

Figure 6:
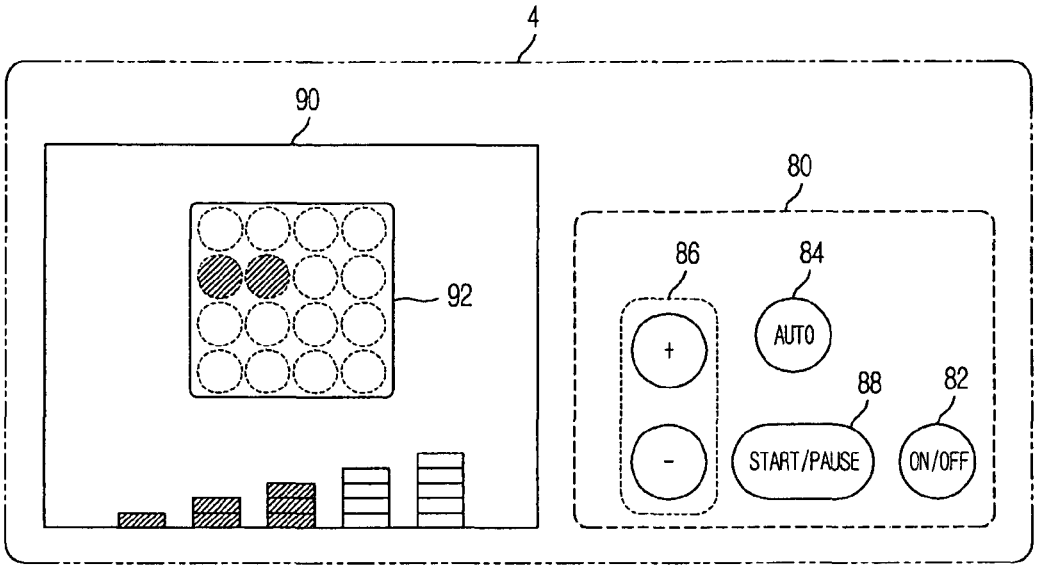
FIG. 6 is a diagram showing an example of displaying a result of detecting the position of a container on a display unit of an induction heating cooker according to an embodiment.

The display unit 90 displays position information of the heating coil L on which the container is placed and the power level of the heating coil L input by a user using the +/− button (see 86 of FIG. 6).

In the embodiment, although the configuration in which one subsidiary controller 60A, 60B, 60C or 60D is provided with respect to four heating coils L arranged in each row and one main controller 70 to control the subsidiary controllers 60A to 60D is provided in the structure of the heating coils L arranged in the 4×4 matrix is described, subsidiary controllers having other configurations may be used or one controller may control all 16 coils without the subsidiary controllers.

Hereinafter, a method of detecting the position of the container placed on the cooking plate, that is the position of the heating coil on which the container is placed, in the induction heating cooker according to the embodiment will be described with reference to FIGS. 3A to 3D.

As described above, in the induction heating cooker in which the small-sized heating coils L are densely arranged below the entire surface of the cooking plate 2, if a high-frequency voltage is simultaneously supplied to all heating coils L in order to detect the position of the container P, a container position detection error may occur due to magnetic field interference between adjacent heating coils.

Accordingly, in the embodiment, a process of dividing and setting the heating coils L of the induction heating cooker into a plurality (n, n is 2, 3, . . . ) of heating coil blocks including one or more heating coils L and supplying a high-frequency voltage to only the heating coils L belonging to each heating coil block B is alternately performed with respect to all the heating coil blocks B, thereby suppressing the container position detection error due to magnetic field interference between adjacent heating coils L. Here, the heating coil block includes one or more heating coils L to which the high-frequency voltage is supplied simultaneously or at a short time interval. If the heating coil block B includes one heating coil L, a high-frequency voltage is alternately supplied to each heating coil L.

In the embodiment, in order to detect the position of the container P, a method of measuring the value of current flowing in each heating coil L while the process of supplying a high-frequency voltage to only the heating coils L belonging to each heating coil block B is alternately performed with respect to all the heating coil blocks B and determining that the container P is placed on the heating coil L if the measured current value is greater than or equal to a predetermined value. Here, the predetermined value is a reference value to determine whether or not the container is placed on the heating coil L and may be set to a value of current flowing in the heating coil L when a container P made of a magnetic material, for example, such as iron (Fe), occupies (covers) 40% of the area of the heating coil L. The predetermined value is set to a value greater than the value of current flowing in the heating coil L when a container P made of a non-magnetic material, for example, such as aluminum (Al) occupies 100% of the area of the heating coil L. If the value of current flowing in the heating coil L is greater than or equal to the predetermined value, that is, if the container P placed on the heating coil L occupies 40% or more of the area of the heating coil L, it is determined that the container P is placed on the heating coil L and the heating coil L is driven in order to cook food. In contrast, if the value of current flowing in the heating coil L is less than the predetermined value, that is, if the container P is placed on the heating coil L but occupies less than 40% of the area of the heating coil L, it is determined that the container P is not placed on the heating coil L and the heating coil L is not driven.

FIGS. 3A to 3D are diagrams showing various examples of dividing and setting heating coils of an induction heating cooker according to an embodiment into a plurality of heating coil blocks. The 16 heating coils L of the induction heating cooker are arranged in a 4×4 matrix, as described above.

Figure 3A:
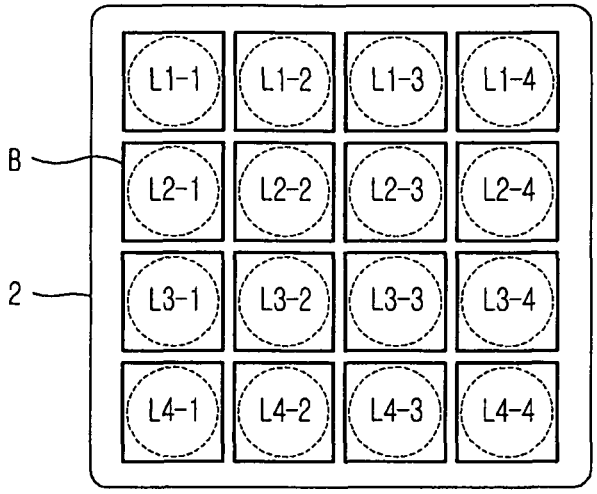
FIGS. 3A to 3D are diagrams showing various examples of dividing and setting heating coils of an induction heating cooker according to an embodiment into a plurality of heating coil blocks.

FIG. 3A shows the case where each of the heating coils L1-1 to L4-4 is set to one heating coil block B. In this case, a total of 16 heating coil blocks is set.

Figure 3B:
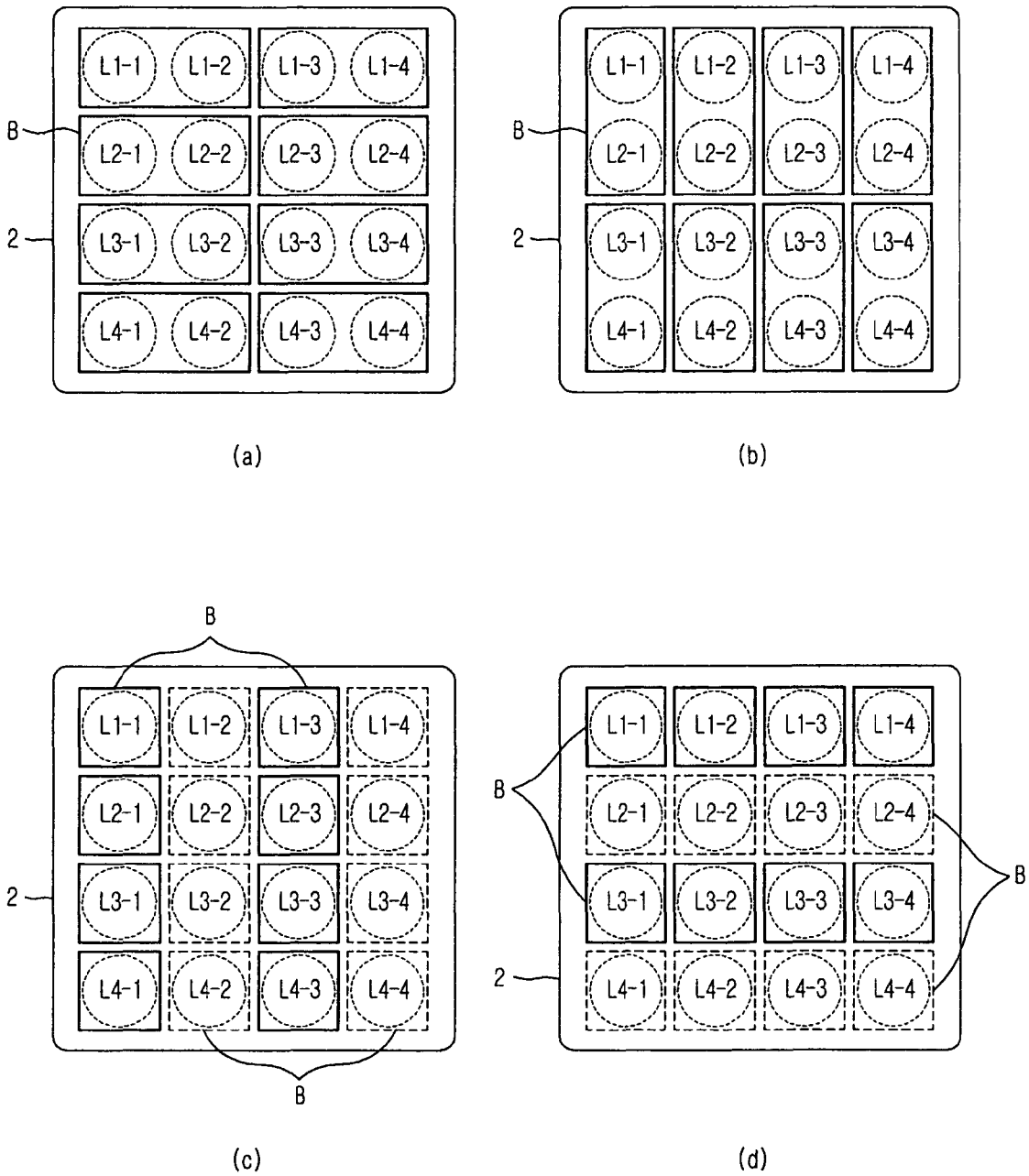

FIG. 3B(a) to 3B(d) show the case where a total of eight heating coil blocks B is set. FIG. 3B(a) to 3B(b) show the case where two heating coils adjacent in a horizontal or vertical direction are set to one heating coil block B, and FIGS. 3B(c) and 3B(d) show the case where two heating coils (for example, L1-1 and L1-3) arranged with another heating coil, interposed therebetween in a horizontal or vertical direction, are set to one heating coil block B.

Figure 3C:
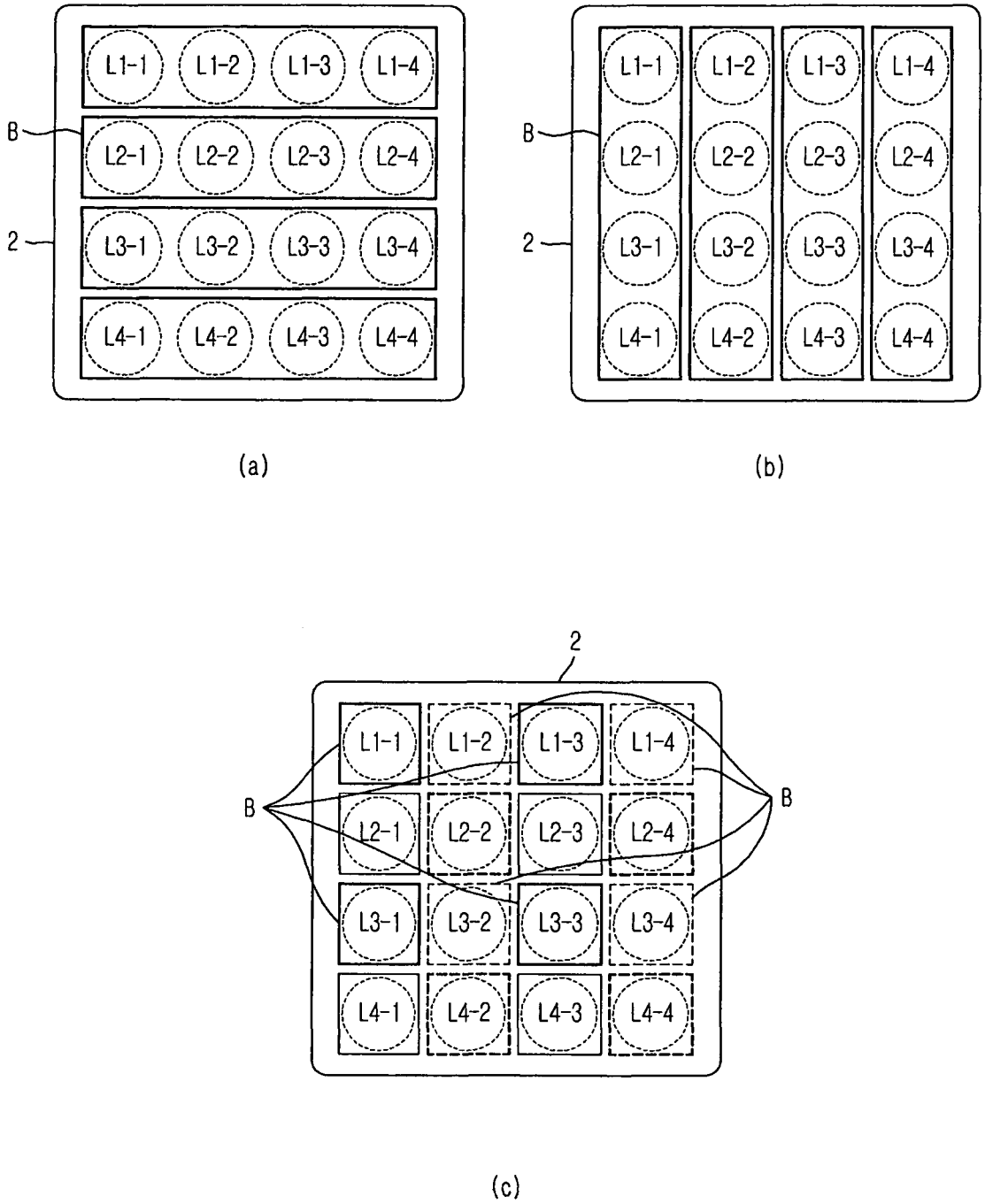

FIG. 3C(a) to 3C(c) show the case where a total of four heating coil blocks B is set. FIG. 3C(a) shows the case where four heating coils L1-1 to L1-4, L2-1 to L2-4, L3-1 to L3-4 or L4-1 to L4-4 arranged in each row of the 4×4 matrix are set to one heating coil block B, FIG. 3C(b) shows the case where four heating coils L1-1 to L4-1, L1-2 to L4-2, L1-3 to L4-3 or L1-4 to L4-4 arranged in each column of the 4×4 matrix are set to one heating coil block B, and FIG. 3C(c) shows the case where four heating coils (for example, L1-1, L1-3, L3-1 and L3-3) arranged with another heating coil interposed therebetween in horizontal and vertical directions are set to one heating coil block B.

Figure 3D:
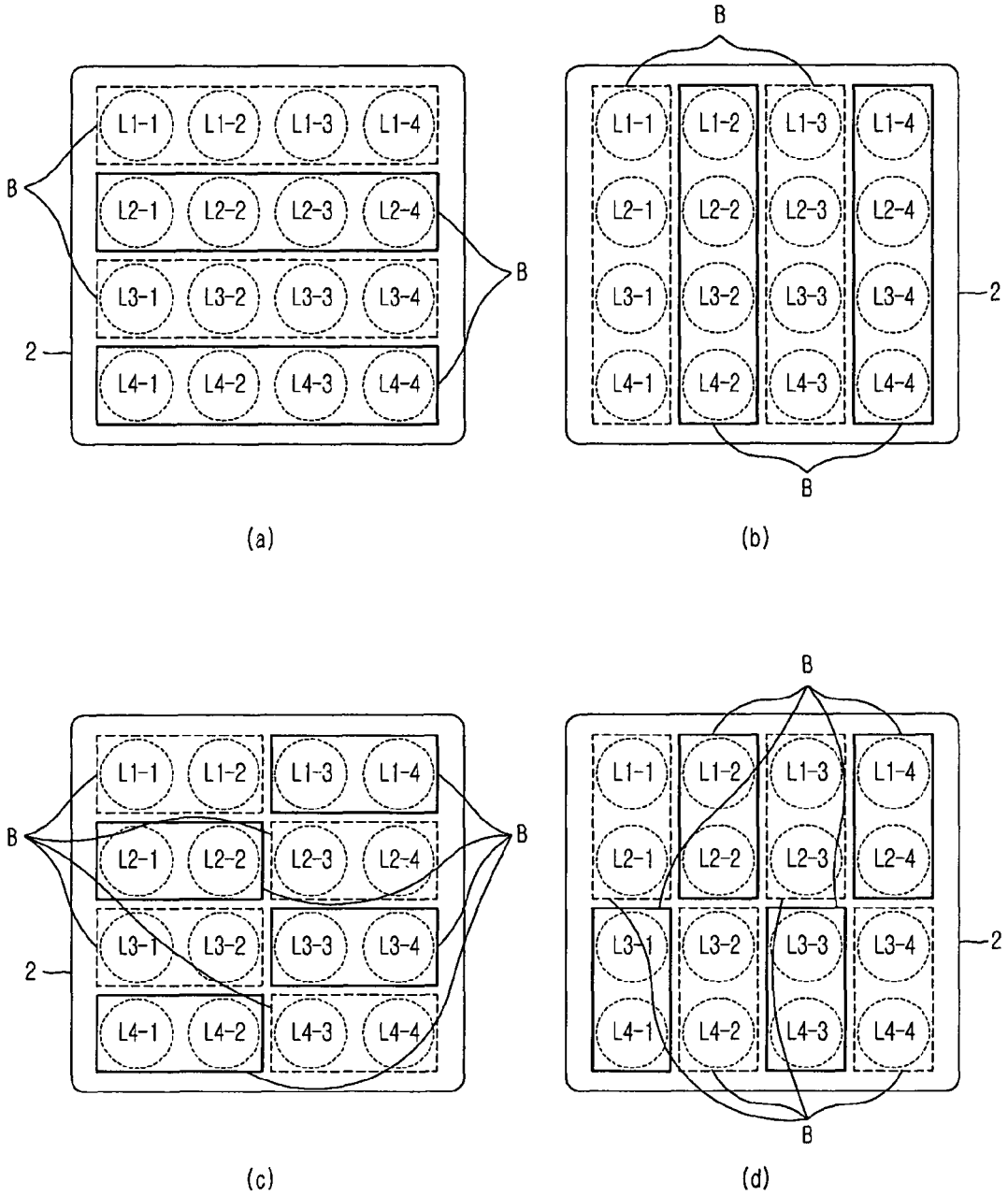

FIG. 3D(a) to FIG. 3D(d) show the case where a total of two heating coil blocks B is set. FIG. 3D(a) shows the case where eight heating coils (for example, L1-1 to L1-4 and L3-1 to L3-4) arranged in two non-adjacent rows of the 4×4 matrix are set to one heating coil block B and FIG. 3D(b) shows the case where eight heating coils (for example, L1-1 to L4-1 and L1-3 to L4-3) arranged in two non-adjacent columns of the 4×4 matrix are set to one heating coil block B. FIG. 3D(c) shows the case where eight heating coils (for example, L1-1 to L1-2, L2-3 to L2-4, L3-1 to L3-2 and L4-3 to L4-4) arranged by dividing the four heating coils arranged in each row of the 4×4 matrix into two groups and connecting the groups of the rows in a zigzag fashion are set to one heating coil block B, and FIG. 3D(d) shows the case where eight heating coils (for example, L1-1 to L2-1, L3-2 to L4-2, L1-3 to L2-3 and L3-4 to L4-4) arranged by dividing the four heating coils arranged in each column of the 4×4 matrix into two groups and connecting the groups of the columns in a zigzag fashion are set to one heating coil block B.

In general, as the number of heating coil blocks B is increased, container position detection accuracy is increased but time required for detecting the container position is increased. In contrast, as the number of heating coil blocks B is decreased, time required for detecting the container position is decreased but container position detection accuracy is decreased. In the case where the same number of heating coils L is set to one heating coil block B, it is possible to increase container position detection accuracy if one heating coil block B is set such that the number of heating coils L adjacent to each heating coil L is decreased.

Although the examples of dividing and setting the heating coils of the induction heating cooker into the plurality of heating coil blocks B are described with reference to FIGS. 3A to 3C, the heating coils may be divided into and set to the plurality of heating coil blocks B using methods other than the above-described method in order to suppress magnetic field interference between adjacent heating coils.

Figure 4:
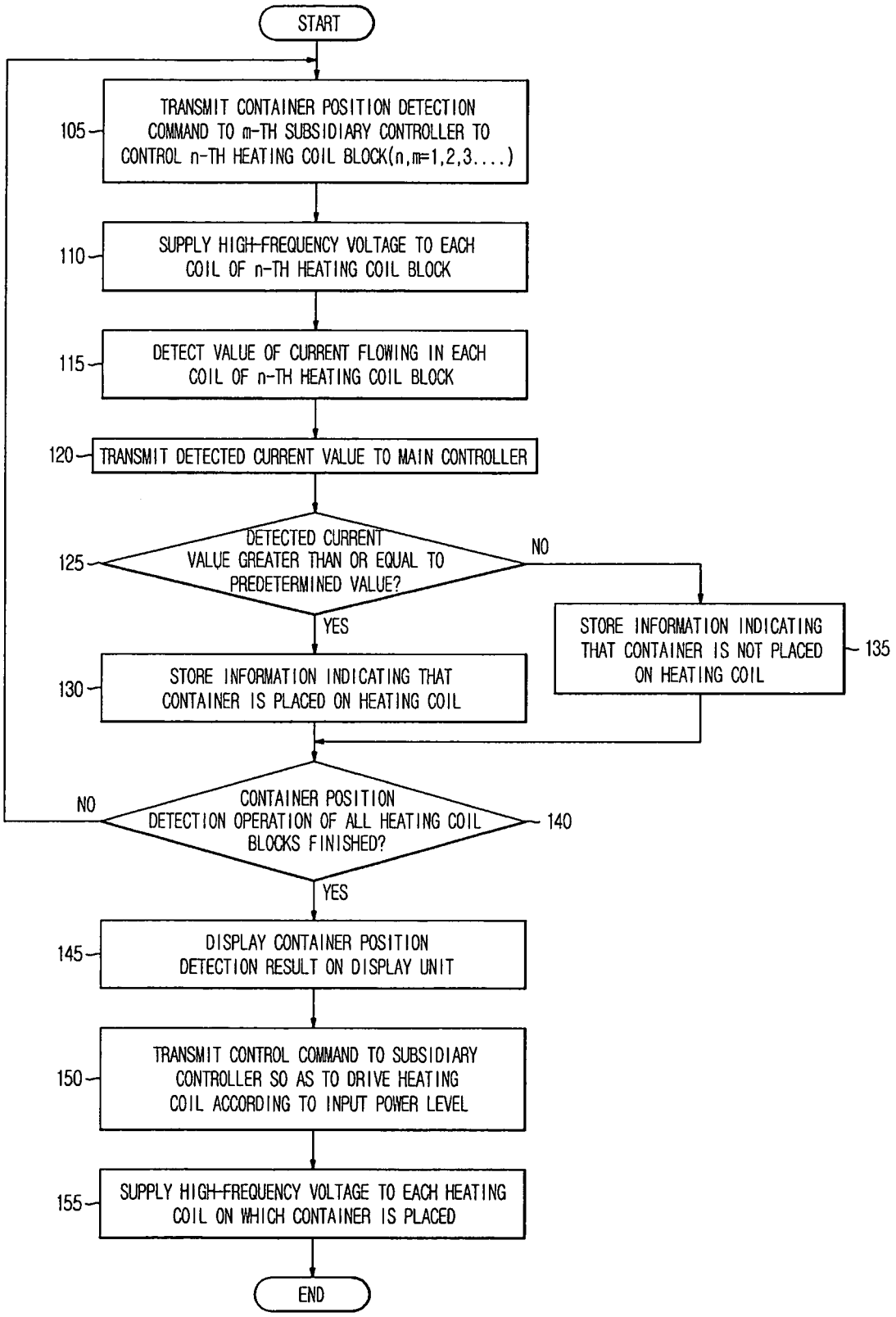
FIG. 4 is a flowchart illustrating a method of controlling an induction heating cooker according to an embodiment.

Hereinafter, a method of controlling the induction heating cooker according to an embodiment will be described with reference to FIGS. 4, 5 and 6.

In the embodiment, it is assumed that the plurality of heating coil blocks B into which the heating coils L of the induction heating cooker are divided and the reference value (predetermined value) to determine whether or not the container P is placed on the heating coil L are stored in the memory 70-1 of the main controller 70. Hereinafter, for convenience of description, the method of controlling the induction heating cooker according to the embodiment when four heating coils L1-1 to L1-4, L2-1 to L2-4, L3-1 to L3-4 or L4-1 to L4-4 arranged in each row of the 4×4 matrix shown in FIG. 5 are set to one heating coil block B will be described.

The user places the container P on the cooking plate 2, operates the ON/OFF button 82, and powers the induction heating cooker on, in order to cook food. Thereafter, the user operates the AUTO button 84 and inputs a position detection command of the container P in order to detect the position (the position of the heating coil on which the container is placed) of the container P on the cooking plate 2.

First, if the user operates the AUTO button 84 and inputs the position detection command signal of the container P, the main controller 70 transmits the container position detection command to the first subsidiary controller 60A to control driving of the four heating coils L1-1, L1-2, L1-3 and L1-4 arranged in the first row of the 4×4 matrix corresponding to the first heating coil block B1 in order to detect the value of current flowing in the heating coils L of the induction heating cooker (105).

The first subsidiary controller 60A which receives the container position detection command sends a control signal to each driver 50A-1, 50A-2, 50A-3 or 50A-4 so as to supply a high-frequency voltage to each coil L1-1, L1-2, L1-3 or L1-4 belonging to the first heating coil block B1 during a predetermined time (for example, 0.5 to 2 seconds) (110).

Each sensor 40A-1, 40A-2, 40A-3 or 40A-4 provided in correspondence with each coil L1-1, L1-2, L1-3 or L1-4 detects the value of current flowing in each coil L1-1, L1-2, L1-3 or L1-4 and transmits the current value to the first subsidiary controller 60A, while high-frequency current flows in each coil L1-1, L1-2, L1-3 or L1-4 (115).

The first subsidiary controller 60A transmits the detected value of current flowing in each coil L1-1, L1-2, L1-3 or L1-4 to the main controller 70 (120).

Thereafter, the main controller 70 determines whether or not the value of current flowing in each coil L1-1, L1-2, L1-3 or L1-4 is greater than or equal to a predetermined value (125). Here, the predetermined value is a reference value to determine whether or not the container P is placed on the heating coil L.

If it is determined that the value of current flowing in each coil L1-1, L1-2, L1-3 or L1-4 is greater than or equal to the predetermined value ("Yes" of 125), the main controller 70 stores information indicating that the container P is placed on the coil L1-1, L1-2, L1-3 or L1-4 in the memory 70-1 (130), and if it is determined that the value of current flowing in each coil L1-1, L1-2, L1-3 or L1-4 is less than the predetermined value ("No" of 125), the main controller 70 stores information indicating that the container P is not placed on the coil L1-1, L1-2, L1-3 or L1-4 in the memory 70-1 (135).

Figure 5:
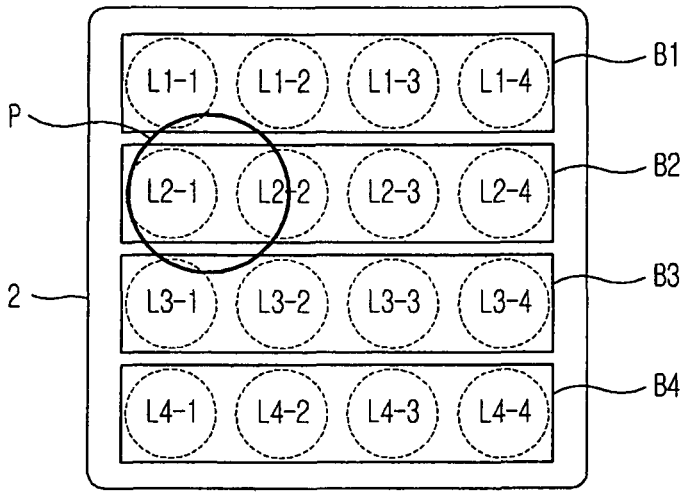
FIG. 5 is a plan view showing the case where a container is placed on two heating coils L2-1 and L2-2 of a second heating coil block B2 in an induction heating cooker according to an embodiment.

In the example shown in FIG. 5, since the container P is not placed on any one of the coils L1-1 to L1-4 belonging to the first heating coil block B1 (for example, to be "placed on," the container P must occupies at least 40% of the area of the heating coil L), information indicating that the container P is not placed on the heating coil L1-1, L1-2, L1-3 or L1-4 is stored in the memory 70-1.

If the container position detection operation of each heating coil L1-1, L1-2, L1-3 or L1-4 belonging to the first heating coil block B1 is finished, the main controller 70 repeatedly performs Operations 105 to 135 in order to perform the container position detection operation of the heating coils L2-1 to L2-4, L3-1 to L3-4 and L4-1 to L4-4 belonging to the second, third and fourth heating coil block B2, B3 and B4.

In the example shown in FIG. 5, since the container P is placed on two heating coils L2-1 and L2-2 of the heating coils L2-1 to L2-4 belonging to the second heating coil block B2, information indicating that the container P is placed on the two heating coils L2-1 and L2-2 is stored in the memory 70-1 (In FIG. 5, it is assumed that the container P occupies 40% or more of the area of the heating coil L2-2).

Thereafter, the main controller 70 determines whether or not the container position detection operation of all the heating coil blocks B is finished (140).

It is determined that the container position detection operation of all the heating coil blocks B is not finished ("No" of 140), the main controller 70 repeatedly performs Operations 105 to 135 with respect to the heating coil blocks B, the container position detection operation of which have yet to be performed.

If it is determined that the container position detection operations of all the heating coil blocks B are finished ("Yes" of 140), the main controller 70 displays the result of the container position detection operation (the position of the heating coil on which the container is placed) on the display unit 90 (145). As shown in FIG. 6, a display surface 92 in which an arrangement structure of the heating coils L arranged in the 4×4 matrix is formed is provided on the display unit 90, and the positions of the heating coils L2-1 and L2-2 on which the container P is placed may be displayed by lighting the positions corresponding to the heating coils L2-1 and L2-2, on which the container P is placed, in the arrangement structure of the 4×4 matrix formed on the display surface 92.

The user confirms the positions of the heating coils L2-1 and L2-2 on which the container P is placed using the display unit 90, operates the +/− button 86 provided on the operation unit 80, and inputs a power level (cooking degree) desired by the user. Next, the user operates the start/pause button 88 and inputs a cooking start command. The power level of the heating coils L input using the +/− button 86 by the user may be displayed in the form of a histogram on a lower end of the display unit 90 as shown in FIG. 6. At this time, the height of the rod is increased in proportion to the input power level (for example, from a first level to a fifth level).

If the power level adjustment signal by the operation of the +/− button 86 and the cooking start signal by the operation of the start/pause button 88 are input by the user, the main controller 70 transmits a control command to the second subsidiary controller 60B to control driving of the heating coils L2-1 and L2-2 on which the container P is placed, in order to drive the heating coils L2-1 and L2-2 on which the container P is placed according to the input power level (150).

Thereafter, the second subsidiary controller 60B which receives the control command sends a control signal to the drivers 50B-1 and 50B-2 in order to drive the heating coils L2-1 and L2-2 which are determined to be the heating coils on which the container P is placed so as to supply a high-frequency voltage to the heating coil L2-1 and L2-2 on which the container P is placed and begins to perform a cooking operation (155).

According to the embodiments, by alternately performing a process of supplying a high-frequency voltage to heating coils belonging to each heating coil block when detecting the position of a container with respect to all heating coil blocks, it is possible to reduce the influence of magnetic field interference between adjacent heating coils when detecting the position of the container and to increase container position detection accuracy.

Although a few embodiments have been shown, and described, it would be appreciated by those skilled in the art that changes may be made in these embodiments without departing from the principles and spirit of the invention, the scope of which is defined in the claims and their equivalents.

What is claimed is:

1. An induction heating cooker comprising:

a plurality of heating coil blocks, each including at least two heating coils;

a plurality of inverters configured to supply a high-frequency voltage to each of the heating coils;

a controller to control operations of the plurality of inverters to alternately supply the high-frequency voltage to each of the heating coil blocks and detect a heating coil on which a container is placed; and a display unit configured to display position information of the heating coil on which the container is placed, wherein the controller controls the plurality of inverters so that the high-frequency voltage is simultaneously supplied to all the heating coils belonging to corresponding heating coil blocks to which the high-frequency voltage is supplied.

2. The induction heating cooker according to claim 1, further comprising a cooking plate provided to place the container thereon, wherein the heating coils are adjacently arranged below the cooking plate.

3. The induction heating cooker according to claim 1, wherein the controller determines that the container is placed on the heating coil if the value of current flowing in the heating coil is greater than or equal to a predetermined value.

4. The induction heating cooker according to claim 3, wherein the predetermined value is a value of current flowing in the heating coil when the container formed of a magnetic material occupies a predetermined ratio of an area of the heating coil.

5. The induction heating cooker according to claim 1, further comprising an operation unit to input a power level of the heating coil on which the container is placed.

6. The induction heating cooker according to claim 5, wherein the controller controls the operations of the plurality of inverters so as to supply the high-frequency voltage corresponding to the power level input through the operation unit to the heating coil on which the container is placed.

7. A method of controlling an induction heating cooker comprising heating coils arranged below a cooking plate and a plurality of heating coil blocks, each including at least two of the heating coils, the method comprising:

alternately supplying the high-frequency voltage to each of the heating coil blocks;

detecting a heating coil on which the container is placed; and displaying position information of the heating coil on which the container is placed, wherein the high-frequency voltage is simultaneously supplied to all the heating coils belonging to corresponding heating coil blocks to which the high-frequency voltage is supplied.

8. The method according to claim 7, wherein, if the value of current flowing in the heating coil is greater than or equal to a predetermined value, the heating coil is determined to be the heating coil on which the container is placed.

9. The method according to claim 8, wherein the predetermined value is a value of current flowing in the heating coil when the container formed of a magnetic material occupies a predetermined ratio of an area of the heating coil.

10. The method according to claim 7, further comprising supplying the high-frequency voltage corresponding to a power level of the heating coil input by a user to the heating coil on which the container is placed.

11. The induction heating cooker according to claim 3, wherein the controller comprises a memory to store information about the plurality of heating coil blocks and a predetermined value to determine whether or not the container is placed on the heating coil.

12. The induction heating cooker according to claim 1, wherein the one or more sensors are one of current sensors, voltage sensors, pressure sensors, or infrared sensors.

13. The induction heating cooker according to claim 4, wherein the predetermined ratio of the area of the heating coil is at least 40% of the area of the heating coil.

14. The method according to claim 9, wherein the predetermined ratio of the area of the heating coil is at least 40% of the area of the heating coil.

15. An induction heating cooker comprising:

a plurality of heating coil blocks, each including at least two heating coils;

a plurality of inverters configured to supply a high-frequency voltage to each of the heating coils; and a controller to control operations of the plurality of inverters to alternately supply the high-frequency voltage to each of the heating coil blocks and detect a heating coil on which a container is placed;

wherein the controller controls the plurality of inverters so that the high-frequency voltage is simultaneously supplied to all the heating coils belonging to corresponding heating coil blocks to which the hiqh-frequency voltage is supplied.

16. The induction heating cooker according to claim 1, further comprising one or more sensors configured to detect a value of current flowing in each heating coil, wherein the controller detects the heating coil on which the container is placed according to the level of the value of current flowing in each heating coil detected by the one or more sensors.

17. The method according to claim 7, wherein the detecting of the heating coil on which the container is placed includes:

detecting a value of current flowing in each heating coil when the high-frequency voltage is supplied; and detecting the heating coil on which the container is placed according to the level of the value of current flowing in each heating coil.

* * * * *

UNITED STATES PATENT AND TRADEMARK OFFICE

CERTIFICATE OF CORRECTION

PATENT NO. : 9,173,252 B2
APPLICATION NO. : 13/137104
DATED : October 27, 2015
INVENTOR(S) : Sung Ho Lee et al.

It is certified that error appears in the above-identified patent and that said Letters Patent is hereby corrected as shown below:

IN THE CLAIMS

Claim 15, Column 12, Line 23

Delete "placed;" and insert --placed,--, therefor.

Claim 15, Column 12, Line 27

Delete "hiqh-frequency" and insert --high-frequency--, therefor.

Signed and Sealed this
Second Day of February, 2016

Michelle K. Lee

Michelle K. Lee
*Director of the United States Patent and Trademark Office*